US007282727B2

(12) United States Patent
Retsky

(10) Patent No.: US 7,282,727 B2
(45) Date of Patent: Oct. 16, 2007

(54) ELECTRON BEAM DIRECTED ENERGY DEVICE AND METHODS OF USING SAME

(76) Inventor: Michael W. Retsky, 237 Strobel Rd., Trumbull, CT (US) 06611

( * ) Notice: Subject to any disclaimer, the term of this patent is extended or adjusted under 35 U.S.C. 154(b) by 325 days.

(21) Appl. No.: 11/187,519

(22) Filed: Jul. 22, 2005

(65) Prior Publication Data

US 2007/0029497 A1 Feb. 8, 2007

Related U.S. Application Data

(60) Provisional application No. 60/591,219, filed on Jul. 26, 2004.

(51) Int. Cl.
*H01J 3/14* (2006.01)

(52) U.S. Cl. ..... 250/492.3; 250/398; 250/397; 378/86; 378/150; 378/76

(58) Field of Classification Search ..... None
See application file for complete search history.

(56) References Cited

U.S. PATENT DOCUMENTS

| | | | |
|---|---|---|---|
| 1,991,236 | A | 2/1935 | Van de Graaf |
| 5,825,123 | A | 10/1998 | Retsky |
| 6,232,709 | B1 | 5/2001 | Retsky |
| 6,473,025 | B2 | 10/2002 | Stolarczyk et al. |
| 6,528,948 | B1 | 3/2003 | Hershcovitch et al. |
| 6,614,151 | B2 | 9/2003 | Retsky |

OTHER PUBLICATIONS

Parmentola, J. et al., "Particle-Beam Weapons," *Scientific American* 1979, vol. 240, No. 4, pp. 54-65.

Sabaka, T.J. et al., "A Comprehensive Model of the Near-Earth Magnetic Field: Phase 3," *NASA/TM*-2000-209894, Apr. 2000.

Jansen, G.H., "Coulomb Interactions in Particle Beams," in *Advances in Electronics and Electron Physics*, Peter W. Hawkes and Benjamin Kazan (editors), Academic Press.

Retsky, M., "Can Coulomb repulsion for charged particle beams be overcome?," Penetrating Radiation Systems and Applications V, edited by F. Patrick Doty, H. Bradford Barber, Hans Roehrig, Proceedings of SPIE, vol. 5199. SPIE, Bellingham, Washington, 2003.

Groves, T. et al., "Electron-beam broadening effects caused by discreteness of space charge," *J. Vac. Sci. Technol.* 1979, vol. 16, pp. 1680-1685.

(Continued)

*Primary Examiner*—Nikita Wells
*Assistant Examiner*—Zia R. Hashmi

(57) ABSTRACT

A method and apparatus is disclosed for an electron beam directed energy device. The device consists of an electron gun with one or more electron beams. The device includes one or more accelerating plates with holes aligned for beam passage. The plates may be flat or preferably shaped to direct each electron beam to exit the electron gun at a predetermined orientation. In one preferred application, the device is located in outer space with individual beams that are directed to focus at a distant target to be used to impact and destroy missiles. The aimings of the separate beams are designed to overcome Coulomb repulsion. A method is also presented for directing the beams to a target considering the variable terrestrial magnetic field. In another preferred application, the electron beam is directed into the ground to produce a subsurface x-ray source to locate and/or destroy buried or otherwise hidden objects including explosive devices.

59 Claims, 5 Drawing Sheets

OTHER PUBLICATIONS

Groves, T.R., "Theory of Coulomb scattering in particle beams using Markov's method," *J. Vac. Sci. Technol. B* 1999, vol. 17, No. 6, pp. 2808-2813.

Retsky, M., "Electrostatic deflection aberrations revisited: Solution proposed to an old problem," *J. Vac. Sci. Technol. B* 1997, vol. 15, No. 6, pp. 2725-2728.

Retsky, M. et al., "Testing an electrostatic deflection innovation: Initial experimental results," *J. Vac. Sci. Technol. B* 2002, vol. 20, No. 6, pp. 2678-2681.

Pierce, J.R., *Theory and Design of Electron Beams*, D. Van Nostrand Company, Inc., New York, 1954, pp. 173-193.

Retsky, M., "Observed Single Atom Elastic Cross Sections in a Scanning Electron Microscope," *Optik* 1974, vol. 41, pp. 127-142.

Leemans, W. et al., "Light Accelerators," *SPIE's oemagazine* Mar. 2005, pp. 22-24.

Retsky, M. et al., "Breast cancer screening: controversies and future directions," *Current Opinion in Obstetrics and Gynecology* 2003, vol. 15, pp. 1-8. (Invited review).

Retsky, M. et al., "Hypothesis: Induced angiogenesis after surgery in premenopausal node-positive breast cancer patients is a major underlying reason why adjuvant chemotherapy works particularly well for those patients," *Breast Cancer Research* 2004, vol. 6, No. 4, pp. R372-R374; available online http://breast-cancer-research.com/content/6/4/R372.

Demicheli, R. et al., "Menopausal status dependence of the timing of breast cancer recurrence after surgical removal of the primary tumour," *Breast Cancer Research* 2004, vol. 6, No. 6, pp. R689-R696; available online http://breast-cancer-research.com/content/6/6/R689.

Barlow, W. et al., "Accuracy of Screening Mammography Interpretation by Characteristics of Radiologists," *Journal of the National Cancer Institute* 2004, vol. 96, No. 24, pp. 1840-1850.

Kidane, G. et al., "X-ray scatter signatures for normal and neoplastic breast tissues," *Phys. Med. Biol.* 1999, vol. 44, pp. 1791-1802.

Evans, R.D., *The Atomic Nucleus*, McGraw-Hill, Inc., 14th printing 1972, pp. 600-631.

"X-Ray Mass Attenuation Coefficients," http://physics.nist.gov/PhysRefData/XrayMassCoef/intro.html.

Retsky, M., "Coulomb repulsion and the electron beam directed energy weapon," Proceedings of SPIE—International Society for Optical Engineering, vol. 5420, Apr. 15, 2004.

Retsky, M., "Using an electron beam to produce a bright isotropic subsurface x-ray source for back illumination in landmine detection," SPIE Conference on Defense and Security, Apr. 2005, Kissimmee, Florida.

Hershcovitch, A. et al., "Air boring and nonvacuum electron beam welding with a plasma window," *Phys. Plasmas* 2005, vol. 12, pp. 057102-1-057102-5.

FIG. 1 PRIOR ART

PARMENTOLA AND TSIPIS DESCRIBED TWO PHYSICAL LIMITATIONS THAT PREVENT AN ELECTRON BEAM DIRECTED ENERGY WEAPON FROM WORKING. AS INDICATED SCHEMATICALLY HERE 1) THE INITIAL 1cm DIAMETER BEAM INJECTED BY THE DEVICE SPREADS TO AN UNACCEPTABLE 5 METER DIAMETER AT OPERATIONAL DISTANCES OF 1000 km AND 2) THE BEAM IS DEFLECTED 1000km BY THE UNSTEADY NEAR-EARTH MAGNETIC FIELD.

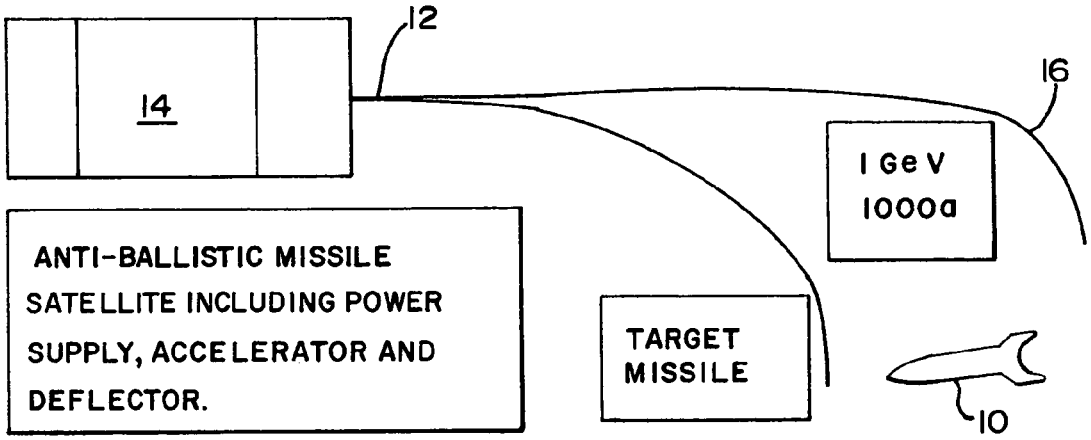

FIG. 2 PRIOR ART

TRAJECTORIES OF REPRESENTATIVE ELECTRONS IN A 1000 AMP BEAM AT 1 GeV THAT PROPAGATES FOR 1000km. THE BEAM IS INITIALLY 1cm IN DIAMETER BUT SPREADS TO 5m DIAMETER DUE TO COULOMB REPULSION.

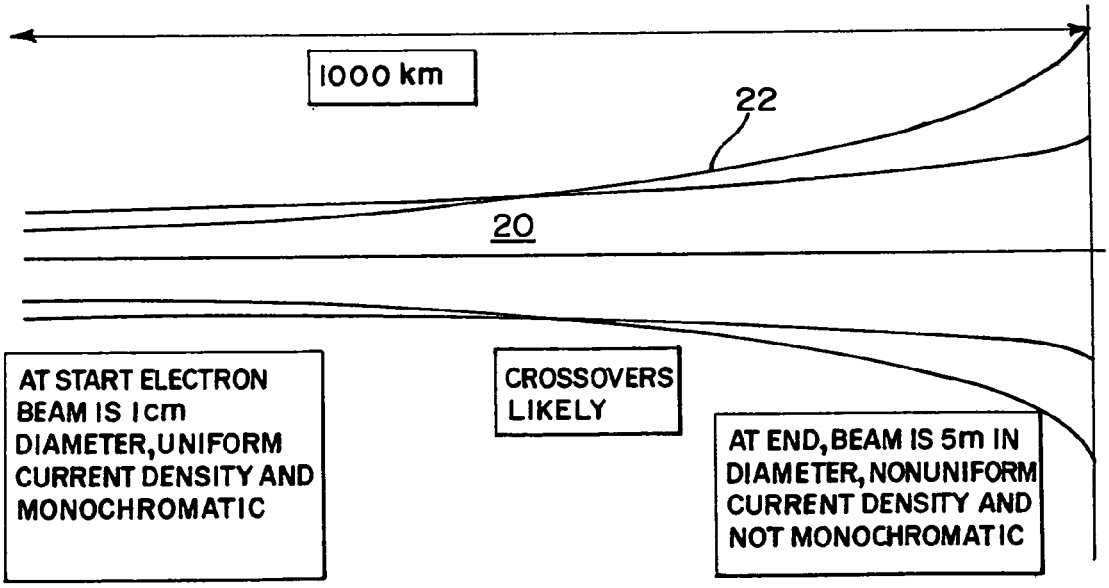

WHAT WOULD RESULT IF WE RAN THE BEAM BACKWARDS? THAT IS, START WITH THE END RESULTS FROM FIG.2 AND REVERSE TIME. WOULD THE BEAM RETURN TO A 1cm DIAMETER PARALLEL BEAM? ACCORDING TO CALCULATIONS, THAT MAY BE TRUE.

IF THE BEAM IS REVERSIBLE AS IN FIG. 3, AN ANTI-MISSILE ELECTRON BEAM DIRECTED ENERGY WEAPON MIGHT WORK AS SHOWN.

THE ELECTRON GUN FOR THE DIRECTED ENERGY WEAPON. ONLY THE FIRST FEW PLATES AND LAST FEW PLATES ARE SHOWN. THE PLATES ARE NOT MECHANICALLY CONNECTED. POSITIONING AND ALIGNMENT IS MEASURED OPTICALLY AND MOTION IS PROVIDED BY GAS JETS ATTACHED TO EACH PLATE.

ENERGY STORED IN FLYWHEELS IS PERHAPS THE IDEAL WAY TO POWER EACH PLATE.

DRAWING OF LANDMINE DETECTOR AND VEHICLE (MANNED OR UNMANNED) TO PUSH IT THROUGH SUSPECTED LANDMINE AREA. ELECTRON BEAM COULD BE SCANNED IN DIRECTION PERPENDICULAR TO PLANE OF DRAWING.

FIG. 8

AIR BASED VERSION OF THE PROPOSED LANDMINE DETECTOR. THE 30 MV ELECTRON GUN IS SLUNG BENEATH A HELICOPTER WITH ELECTRON BEAM EXIT POINTING DOWN. A GRID ARRAY OF X-RAY DETECTORS IS SUPPORTED BY A MECHANICAL FRAMEWORK SUCH THAT THE DETECTORS ARE RESTING ON THE SOIL SURFACE WHEN THE ELECTRON GUN IS A METER OR SO OFF THE SURFACE. READINGS ARE TAKEN OF THE AREA UNDER THE GRID AND THEN THE HELICOPTER MOVES TO ANOTHER AREA FOR ANOTHER SCAN PROCEDURE.

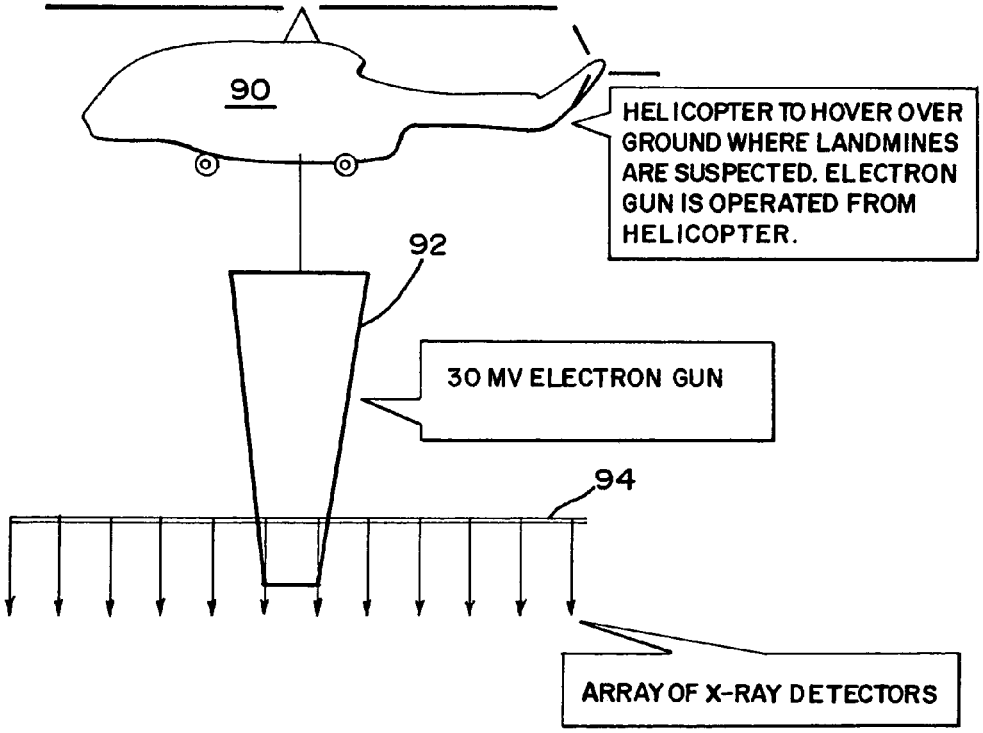

ELECTRON BEAM DIRECTED ENERGY DEVICE AND METHODS OF USING SAME

RELATED APPLICATIONS

The present patent document claims the benefit of the filing date under 35 U.S.C. §119(e) of Provisional U.S. Patent Application Ser. No. 60/591,219 filed Jul. 26, 2004, the contents of which are incorporated herein by reference.

FEDERALLY SPONSORED RESEARCH OR DEVELOPMENT

This invention was made in part while under contract DE-FG36-01GO11021 with the Department of Energy.

BACKGROUND OF THE INVENTION

This invention relates to electron beam directed energy devices. In particular, this invention is directed to an electron beam device that can be used as a directed energy weapon and with modifications as a landmine detection device.

Peaking a few decades ago, there has been ongoing interest in the concept of using particle accelerators in space as weapons to destroy ballistic missile targets above the atmosphere. While much of this has been kept confidential for national security reasons, Parmentola and Tsipis presented a landmark paper on this subject in Scientific American in 1979 (J. Parmentola and K. Tsipis, "Particle-Beam Weapons," Scientific American, 240:54-65, 1979). The authors presented scientific reasons why such weapons would be highly useful, but also dramatized the fundamental reasons why these weapons could never work.

Particle beam weapons differ from other instruments of war that carry destructive energy to the target in the form of explosive warheads in ponderous containers such as artillery shells or missile casings. Particle beam weapons, of which electron beams are just one possibility, increase the kinetic energy of a large number of individual atomic or subatomic particles and then direct them collectively against a target. Every particle in the beam that strikes the target will transfer a fraction of its kinetic energy to the target material. If enough particles hit the target in a short time, the deposited energy would be sufficient to burn a hole in the skin of the device, detonate the chemical explosives or disrupt the electronics inside including software. The most significant advantage of high-energy particle beam weapons over missiles is that, like lasers, they propagate at essentially the speed of light.

In the above article, the authors presented many small but practical problems of particle-beam weapons such as how to generate sufficient power in space, how to deal with countermeasures, and how to find targets among decoys. They also discussed two problems that they considered unsolvable. That is, the smaller problems may be considered very difficult scientific and engineering problems that may challenge practical implementation. However, even if all those could be dealt with, two significant problems remained that were unsolvable due to fundamental physical limitations that no amount of Herculean engineering could resolve.

These fundamental problems are (1) that Coulomb repulsion of a particle beam spreads the energy over a large area at reasonable distances to targets, and (2) that the near-earth magnetic field deflects the beam and is somewhat variable. (The beam is steered electrically by magnetic fields or electric fields. Mechanical steering would not be fast enough.) These two problems are shown schematically in FIG. 1.

A practical electron beam weapon would need to hit a target that is 1,000 km away with a 1000 amp beam having an energy of 1 GeV for 0.1 msec. Furthermore, the beam needs to be 1 cm or so in diameter at the target in order for the deposited energy to be sufficiently intense. The authors indicate that a 1 GeV electron beam of 1000 amps would spread from an initial 1 cm diameter to a 5 meter diameter at 1,000 km due to Coulomb repulsion. They also indicate that a 1 GeV beam would be deflected by 1,000 km over a distance of 1,000 km due to the earth's magnetic field. It is well known that the earth's magnetic field is also not completely steady. Under such unstable conditions, it would be close to impossible to make a workable weapon that could reliably hit a target 1000 km away with enough energy to destroy it. Also, there are only 400 or so seconds to distinguish between multiple targets and decoys in the initial phase of a ballistic missile's trajectory and then destroy the targets. There is more time, however, near the apogee section of travel in which to detect and destroy the missile compared to its ascent and reentry phases.

Much has been learned about near-earth magnetic fields in recent years. The near-earth magnetic field is 97% due to the earth's core, and ranges in magnitude from 30,000 nanoTesla (nT) at the equator to 50,000 nT at the poles. The solar quiet magnetic field variation is a manifestation of an ionospheric current system. Heating at the day side and cooling at the night side of the atmosphere generates tidal winds, which drive ionospheric plasma against the geomagnetic field inducing electric fields and currents in the dynamo region between 80-200 km in height. The current system remains relatively fixed to the earth-sun line and produces regular daily variations that are directly seen in the magnetograms of geomagnetic "quiet" days. On "disturbed" days there is an additional variation that includes superimposed magnetic storms. Because the geomagnetic field is strictly horizontal at the magnetic equator, there is an enhancement of the effective Hall conductivity, called the Cowling conductivity, which results in an enhanced eastward current, called the equatorial electrojet, flowing along the day side magnetic equator. In addition, auroral electrojets flow in the auroral belt and vary in amplitude with different levels of magnetic activity.

The solar quiet fields are on the order of 10-50 nT, depending upon component, latitude, season, solar activity, and time of day. The magnetic signature of the equatorial electrojet can be about 5-10 times that of solar quiet, and that of the auroral electrojets can vary widely from 10-20 nT during quiet periods to several thousand nT during major magnetic storms. It is complex, but the near-earth magnetic field has both a significant predictable varying component and also a significant non-predictable varying component.

The prior art lacks a workable concept of how to use an electron beam directed energy device that can overcome Coulomb repulsion and the earth's varying magnetic field and steer the beam such that it can impact and destroy objects approximately 1000 km distant, such as missiles in outer space.

Another major unsolved problem is the detection and/or the destruction of landmines. Since their early widespread use in the First World War, landmines have proved to be an inexpensive and effective military weapon. With landmines, an enemy is denied safe access to specific areas. They can delay, divert or destroy enemy forces—including those numerically and technologically superior. They can impede supply lines and demoralize a foe. Antitank landmines can interfere with vehicular flow and antipersonnel landmines protect antitank landmines, defend large and small areas and effectively deny access to bridges, borders and other areas of important pedestrian flow in specific regions. This will disrupt commerce, instill fear among non-combatants, and act as a psychological weapon to undermine confidence in governments. They are also effectively used in booby-traps. Costing as little as $3 to $30 each, these are perhaps the most cost-effective weapons available in any military arsenal—thus assuring their ubiquity.

There are estimated to be 50 to 100 million landmines including new placements and those left over (but still operational) from forgotten old conflicts. These latter are particularly injurious to civilians including farmers and young persons playing in fields. It is a worldwide-recognized hazard. In a concerted effort to remove this scourge, 123 countries met in 1997 to sign the "Convention on the Use, Stockpiling, Production and Transfer of Anti-Personnel Mines and on Their Destruction." There are many countries that have not as yet signed this agreement. However, all would agree that leftover landmines are a major health and societal problem in many areas of the world. Finding and removing both simple and sophisticated concealed explosives in asymmetrical warfare and terrorism is an equally important need.

From a technical viewpoint, finding buried landmines and concealed explosives is difficult since there is usually only access to one side of the object. With this limitation, methods that have been proposed include penetrating radiation (neutron and photon) plus acoustic energy. For example, U.S. Pat. No. 6,473,025 was issued to G. Stolarczyk for a ground penetrating radar for landmine detection. Detection of anomalous objects in this patent, however, takes the form of measuring secondary emissions (activation) or radiation scattering. This is far less efficient than detection in a direct transmission or shadow image mode in which case there are many more measurable events per incident photon. As an analogy, cancers deep within otherwise normal organs are commonly identified with x-ray imaging, but only because the source of x-rays is on one side of the subject and a detector is on the other side. This is called back-illumination and it produces a shadow image of the subject at the detector with observable local variations in x-ray attenuation. If there were only access to one side of a human subject, x-radiation would be practically worthless in finding occult cancer.

X-rays are produced when energetic (in comparison to rest-mass energy) electrons are slowed, change direction, or stopped suddenly when they impact an atom of relatively high atomic number. This is called bremsstrahlung or breaking radiation. Electrons can travel in the atmosphere and to a lesser extent in soil. As the beam electrons interact with high Z atoms, they undergo directional changes before they stop. The resulting x-radiation is emitted in all directions from a plume within the material. X-rays are also emitted when impacted atoms undergo induced orbital transitions if energetically possible. These are also emitted in all directions.

The prior art lacks a method using an electron beam device to produce a sub-earth surface source of x-radiation. The prior art also lacks an electron beam device to locate or destroy buried objects including explosives.

SUMMARY OF THE INVENTION

In view of the above, the present invention provides an electron beam directed energy device and methods for using the device to either impact missiles or rockets located outside or within the earth's atmosphere, or to detect landmines located at or beneath the earth's surface.

According to one aspect of the invention, a directed energy device is provided. The device includes an electron gun generating a plurality of electron beams. The electron beams are disposed such that their beam axes are oriented in a pre-configured direction in order to substantially overcome Coulomb repulsion at distances of 100 kilometers or greater. An electron accelerator section is also provided and positioned after the electron gun. The electron acceleration section consists of a plurality of sequential conductive shaped plates, where each such plate contains at least one aperture per electron beam. Each aperture is positioned at the respective beam's axis. The shapes of the plates are essentially normal to the electron beams, and the spacing of the plates from one another is greater than the electrical breakdown limit. Voltages are applied to each plate relative to the other conductive plates.

In another aspect of the invention, a directed energy device is also provided. The device includes an electron gun having at least one beam of electrons. The beams of electrons are disposed such that at least one beam axis is oriented toward the surface of the earth. The electron gun is also located at a position of up to 200 meters above the earth's surface. An electron acceleration section is also included and is operable to energize the electron beams to energy levels of between 10 MeV and 200 MeV. The device is operable to deposit energy below the earth's surface.

Other aspects of the invention are directed to methods for impacting ballistic missiles using a directed energy device, and for detecting landmines using a directed energy device, respectively. The presently preferred embodiment of the invention includes an energy storage device in the form of a flywheel.

By overcoming Coulomb repulsion of electrons traveling in a beam at substantial distances, a directed energy device can be employed to impact, disable and even destroy missiles and rockets traveling both within and outside the earth's atmosphere. The same techniques for directing an electron beam can also be used at lesser distances and with less energy to detect and even destroy landmines located at or beneath the earth's surface. Both of these applications are intended to protect earth's inhabitants from the harmful and often fatal effects of devastating weapons such as missiles and landmines.

These and other features and advantages of the invention will become apparent to those skilled in the art upon a review of the following detailed description of the presently preferred embodiments of the invention taken in conjunction with the appended drawings.

BRIEF DESCRIPTION OF THE DRAWINGS

FIG. 1 is a schematic view of a prior art anti-ballistic missile charged particle directed energy device.

FIG. 2 is a cross-sectional longitudinal view of the trajectory of a charged particle beam over large distances.

FIG. 8 shows an airborne embodiment of the landmine detection device shown in FIG. 7.

DETAILED DESCRIPTION OF THE PRESENTLY PREFERRED EMBODIMENTS OF THE INVENTION

Figure 3:
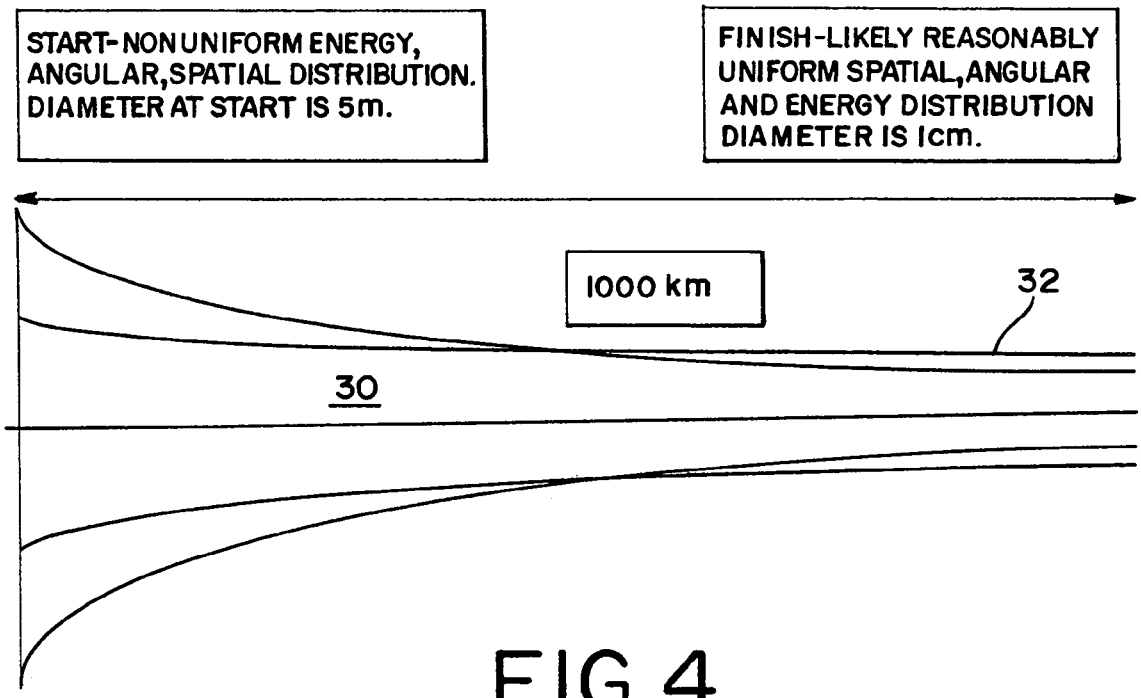
FIG. 3 is a view of the beam trajectory shown in FIG. 2, but run in reverse.

Turning to the drawings, where like reference numerals represent like elements throughout, FIG. 1 shows a proposed prior art electron beam directed energy weapon for use in outer space. Two physical limitations that prevent an electron beam directed energy weapon of the kind shown in FIG. 1 from working on a target 10 are (1) an initial 1 cm diameter beam 12 projected by the device 14 spreads to an unacceptable 5 meter diameter 16 at operational distances of 1000 km, and (2) the beam can be deflected by as much as 1000 km by the unsteady near-earth magnetic field (not shown). As will be described in detail below, both of these effects are addressed and solved by the presently preferred electron beam directed energy weapon.

In order to design a working electron beam directed energy weapon, computations for Coulomb repulsion for pulsed relativistic beams of 1000 amps over distances of 1000 km would be useful, but is a relatively unknown subject of which little has been written. However, in lithography applications where Coulomb repulsion has been well studied, there are three well-known theoretical components to Coulomb repulsion: (1) that a test charge is deflected radially by the electric field (magnetic field constriction is ignorable at these current densities) due to the spread out position of the remainder of the beam, (2) the Boersch effect which produces a spread in longitudinal energy or velocity due to stochastic interactions of each electron with all the individual electrons in the remainder of the beam (producing chromatic aberrations downstream), and (3) a spread in transverse position due to stochastic interactions with the individual electrons in the beam. It is well known that for a uniform current density beam, all electrons experience a net radially outward Coulomb force. FIG. 2 shows how the trajectories shown in FIG. 1 of representative electrons 20 in a 1000 amp beam 22 at 1 GeV propagate for 1000 km. Beam 22 is initially 1 cm in diameter and spreads to 5 m in diameter due to Coulomb repulsion. But this does not necessarily hold true for a non-uniform current density beam. It is also possible that the outward directed Coulomb force could be matched and overcome by inward directed momentum focusing to a beam with smaller diameter. From examining the trajectories in FIG. 2, a solution to the Coulomb repulsion problem would be to run the beam backwards if the trajectory is reversible.

By running the electron beam backwards, the first component of Coulomb repulsion mentioned above is completely reversible. The second and third components are not reversible, but will be smaller in reverse since the beam is far apart during the early part of travel so any stochastic terms will have less time to produce deflection than in the forward direction. Based on known computations, the ratio of irreversible to reversible components of the Coulomb repulsion should be vanishingly small (approximately $10^{-15}$). As a conservative estimate, the irreversible component is of the order of 0.1 mm.

Thus, as shown in FIG. 3, if the beam 32 were generated backwards, that is start with the end results from FIG. 2 and reverse time, the initial 5 meter wide beam would very closely come to a 1 cm diameter parallel beam at 1000 km. Representative electrons 30 are indicated in the beam 32 shown in FIG. 3. Accordingly, the Coulomb repulsed beam shown in FIG. 2 could be run in reverse. That is, start with a parallel, uniform current density 1 cm diameter beam with 1 GeV energy and 1000 amps streaming out from an accelerator. Then, using the beam position and velocity at 1000 km as a new starting condition, reverse time and run the beam back. The 5 meter wide slightly converging non-monochromatic beam will converge to become nearly parallel, monochromatic and 1 cm in diameter at 1000 km, as shown in FIG. 3.

A. Electron Beam Directed Energy Weapon

Figure 4:
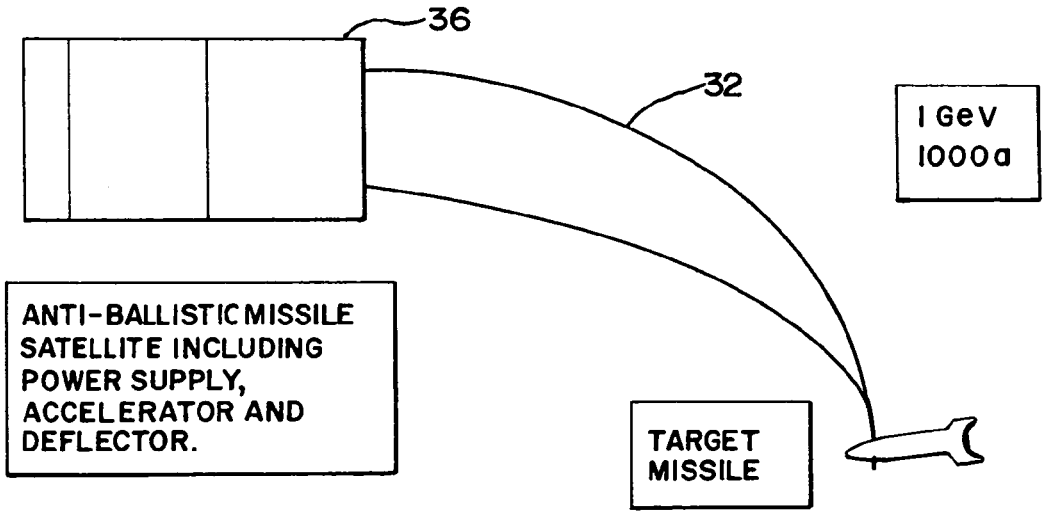
FIG. 4 is a schematic view of an electron beam directed energy weapon according to the invention.

Applying the results of reversing the beam shown in FIG. 3, FIG. 4 shows how the beam would function according to the directed energy weapon of the invention. If the beam 32 is reversed as shown in FIG. 3, an anti-missile electron beam directed energy weapon 36 would function as shown in FIG. 4. FIG. 4 shows a schematic drawing that is analogous to FIG. 1.

Figure 5:
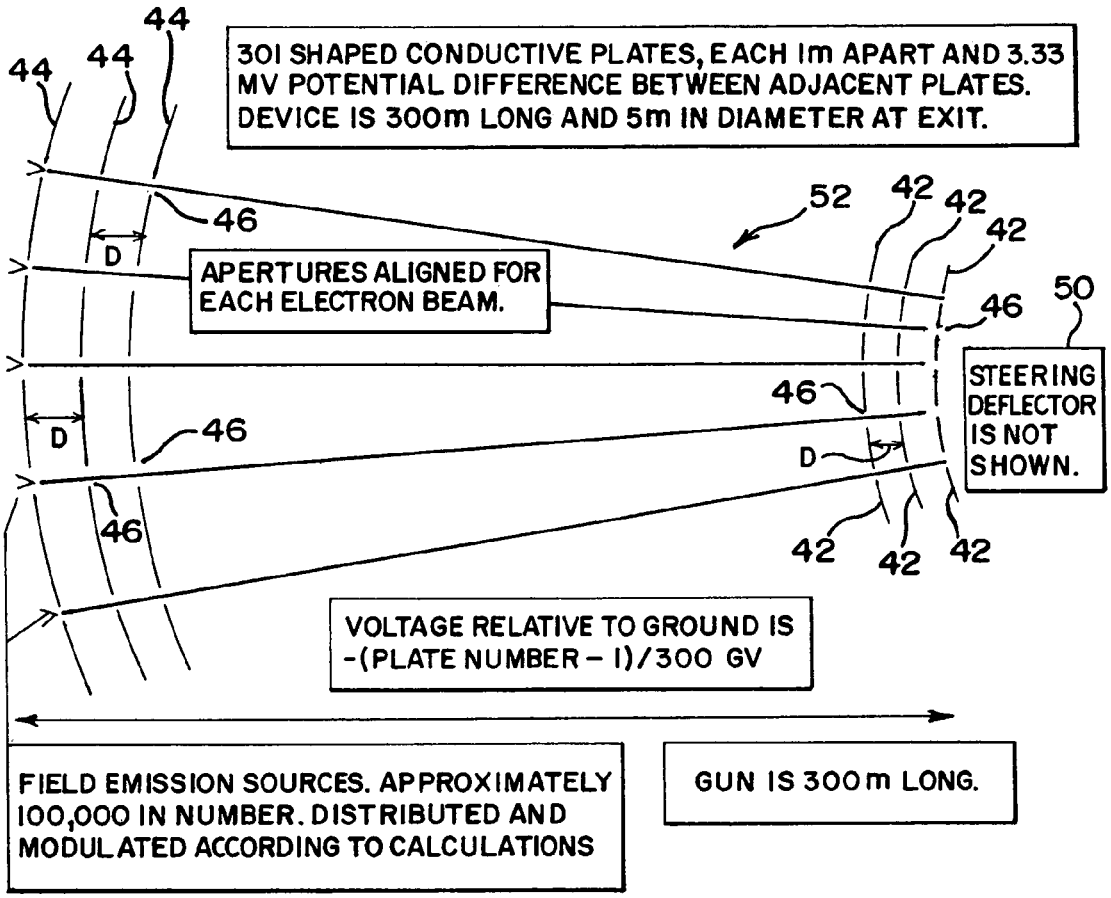
FIG. 5 is one presently preferred plate arrangement of the device shown in FIG. 4.

FIG. 5 shows a cross-section of one presently preferred electron gun 40 for a directed energy weapon 36. Only the first few plates 42 and last few plates 44 are shown. Apertures 46 for the electrons are also shown. The plates are preferably not mechanically connected. Positioning and alignment is measured optically and motion is provided by gas jets (not shown) attached to each plate. The steering mechanism 50 would be located to the right of the last plate through which the beam exits the gun.

The preferred embodiment is to design the optics with a computer program that takes all electrons as discrete charges. Such a program is available from Munro's Electron Beam Software Ltd. (www.mebs.co.uk).

If the electron optics is reversible, then starting from the desired landing point and working backwards to the needed gun design will work. Alternatively, if the optics is not sufficiently reversible, a trial-and-error computational method using a ray trace program will still provide a solution. Charges could be taken as either discrete or a continuum (software also available from Munro's Electron Beam Software, Ltd.). Another alternate embodiment is to empirically design the electron gun geometry and voltages to minimize beam landing spread at the desired target distance.

A prior art mechanism for steering a 5 meter wide beam without introducing aberrations is disclosed in U.S. Pat. Nos. 5,825,123, 6,232,709, and 6,614,151, commonly owned by the owner of this application, the contents of which are incorporated herein by reference. Using such a mechanism, the deflection angle will be limited due to the stiffness of the 1 GeV beam and the difficulties from the need to use very high deflection voltages. The steered beam could also be steered with a magnetic field deflector (not shown), or both magnetic and electric field deflectors (not shown).

One presently preferred embodiment of an electron beam weapon is composed of a large electron gun 52 that is preferably 300 m in length and 5 m in diameter (the beam envelope) as seen in FIG. 5. The beam emitted from the gun does not have to be exactly round in cross-section although that would be preferable. There would be approximately 100,000 or more field emission tip electron sources arranged on a curved (convex) conductive surface aiming along trajectories that would fit the previously mentioned problem run in reverse. This is similar to prior art guns with a concave shaped cathode.

To produce a 1 GeV beam, it would take 301 properly contoured plates 42, 44 with apertures 46 arranged to passage the beams from all the individual field emission sources. (The curvature of the plates is exaggerated in FIG. 5 for emphasis. In reality, they are within a fraction of a millimeter of being perfectly flat.) Preferably, each of the plates 42, 44 needs to be $10^9/301$ or 3.33 million volts more positively charged than the previous plate on the cathode side. There may be more or less plates, more or less voltage between plates and the plates may not have the same spacing or the same voltage difference from adjacent plates, but the electric field between plates should not exceed the breakdown level and the total voltage should be approximately $10^9$ volts. The exit plate is preferably at ground potential. Apertures 46 in each plate are aligned to provide the proper trajectory as determined from FIG. 3. Each plate 42, 44 is preferably separated by a 1 meter distance D from adjacent plates 42, 44. The fields between the plates 42, 44 are composed in the same manner as an electron microscope. This field size is practical (and conservative) from high voltage breakdown considerations. The gun is preferably assembled in space due to its size, etc.

Getting a pulsed current of 1000 amps from 100,000 field emission sources requires a relatively modest 10 mA current per tip. Although they could be, the plates 42, 44 are not preferred to be mechanically connected one to another. They are each free to move under the control of small gas jets or other means (not shown). Laser beams directed down alignment apertures (not shown) guide positioning. Free floating plates 42, 44 allow a design without the need for mechanically rigid high voltage insulating spacers; the surface of which is often a path of high voltage breakdown. To generate a beam with non-monochromatic energy distribution as starting conditions, the field emission tips could be at different potentials if the energy differences are small, or even be placed on different curved plates if the energy differences are large.

Although large in dimensions, the gun itself would not be massive since the main components (the 301 shaped surfaces) are not massive themselves. The surfaces are preferably formed of thin metallic sheets or metalized polymer membranes, for example. They could be folded or preferably rolled up for transportation in a shuttle cargo bay, and unfolded into shape once they are unloaded in space.

The collection of excessive charge on the device itself is preferably prevented by draining off positively charged ions as the beam is operated. Charging capacitors and jettisoning positive plates in conjunction with the beam pulsing can be performed to accomplish this result.

Figure 6:
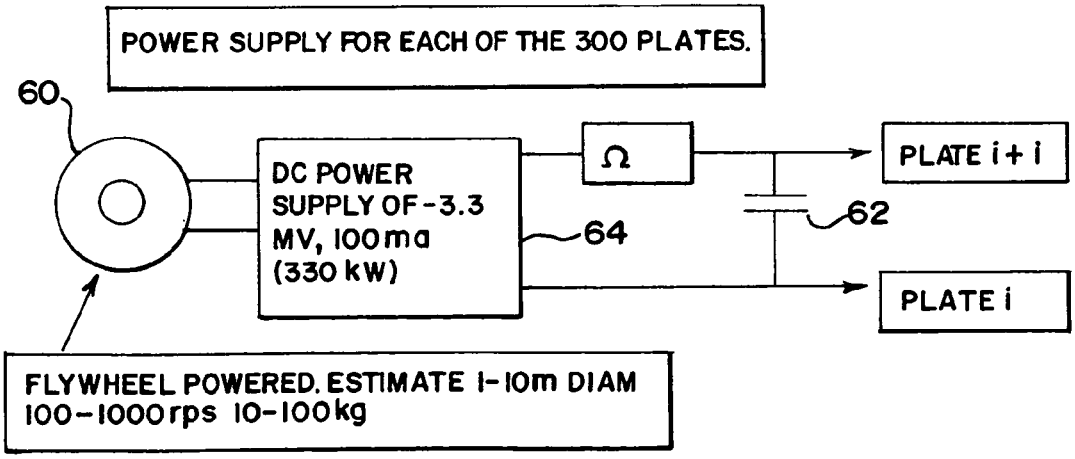
FIG. 6 is one presently preferred flywheel-powered power source.

FIG. 6 shows one presently preferred power source for the device shown in FIG. 5. Energy stored in flywheels 60 is preferably employed to power each plate 42, 44. The suggested flywheel 60 is preferably 1 to 10 meters in diameter, having a mass of 10 to 100 kg and rotating at 100 to 1000 revolutions per second (the smaller numbers are preferred). A high-voltage capacitor 62 is also shown as an alternative power supply. If used, the capacitors 62, depending on the capacitance, inductance, and internal resistance, are preferably capable of powering the beam for a limited number of pulses without the need for flywheels 60.

During the short time of operation, the beam has an enormous amount of energy. One thousand amps at 1 GV yields 1000 Gigawatts of power. (The energy in the beam is the power times duration of the pulse. For 0.1 msec pulses, this amounts to 100 Megajoules per pulse.) According to the preferred embodiment shown in FIG. 6 and described above, energy storage is in the form of a series of rotating flywheels 60 that are coupled to generators 64. Each preferably 3.33 MV power supply for each plate 42, 44 has its own rotational energy storage setup, which solves the problem of how to power them while each is at a different high voltage. The rotational energy could be built up during times when the beam is idle so that it is readily available for times of need. The presently preferred flywheel 60 rings provide a reasonable rotational energy storage unit. Though the gun has very large physical dimensions, the 300 or so flywheels 60 (total of 3,000 to 30,000 kg) are the most massive part of the device. This design results in the ability to provide up to 1 pulse per second continually for weeks.

Chemical power (pinwheel rockets), gas jets, or even solar power sources (not shown) are used to get the storage wheels 60 up to rotational speed. After this energy is built up, keeping it stored requires continual and/or periodic re-injections of spin energy. Alternatively, energy storage capacitors 62 between adjacent plates may also help power the device. They may require smaller voltage differences and correspondingly more plates as a design trade-off.

Taking into account the 10 km uncertainty in beam trajectory at 1000 km due to the unpredictable component of the near-earth magnetic ambient field, there are several alternative embodiments contemplated in order to hit a 1 meter target. In a first embodiment, a line shaped beam is created and swept in a raster fashion like a broom over a 10 km by 10 km field horizontally and then vertically. While doing this, infrared telescopes (not shown) in orbit and/or earth-based are used to look for sudden heating of the target, or x-ray sensors are used to look for sudden x-ray flashes—in real time since the beam is travelling essentially at the speed of light. When a heat surge or x-ray, or any other emission from that target is detected, it can be correlated to the beam position so that the target can be located and/or destroyed in short time.

There are other ways to solve this location problem. In a second embodiment, knowing the magnetic field to 1 part in $10^7$ between the gun and target (mostly near the gun), or alternatively using an array of distant test targets that can be used for trajectory calibration, can be used to aim or locate the beam. This is analogous to a target-shooter who can either know the wind at all points between him and the target or take a few test shots for calibration. The first may be impractical, but the second is not. The electron gun preferably sends lower energy bursts at full beam voltage to test targets strategically placed to obtain feedback on magnetic deflection.

The preferred device would not operate well in a vacuum worse than $10^{-6}$ torr due to unacceptable corona effects. If the orbital environment is not that good (lower than 500-600 km orbit), the entire gun can be contained within a sealed enclosure and exhausted down to required vacuum levels. A thin conductive membrane window or preferably a plasma vacuum valve would be used to allow the beam to exit while keeping the chamber at a required vacuum level. Testing and developing the device in the laboratory would require methods to provide low pressure. Preferred operation thus is in orbit higher than 600 km.

In addition to protection from ballistic missiles, since electrons can penetrate some distance in air, the above-described device also can be used to protect from threatening high-flying aircraft. Another alternative, but not preferred, embodiment is to use an electron beam directed energy weapon in a geosynchronous orbit at 40,000 km altitude. The solved problem is that only a few devices are needed to protect the entire country rather than the 150 as noted in the prior art. The new problem is of course, because of the further distance, Coulomb repulsion and the ability to hit a target are more difficult. Another possibility for use within the atmosphere is to support the device with balloons or within aircraft at high altitude. The device would need to be enclosed in a sealed container and pumped to the required vacuum levels. The preferred method, however, is to use 150 devices in 600 km or larger orbits in order to cover and protect the desired area.

B. Landmine Detection Device

Figure 7:
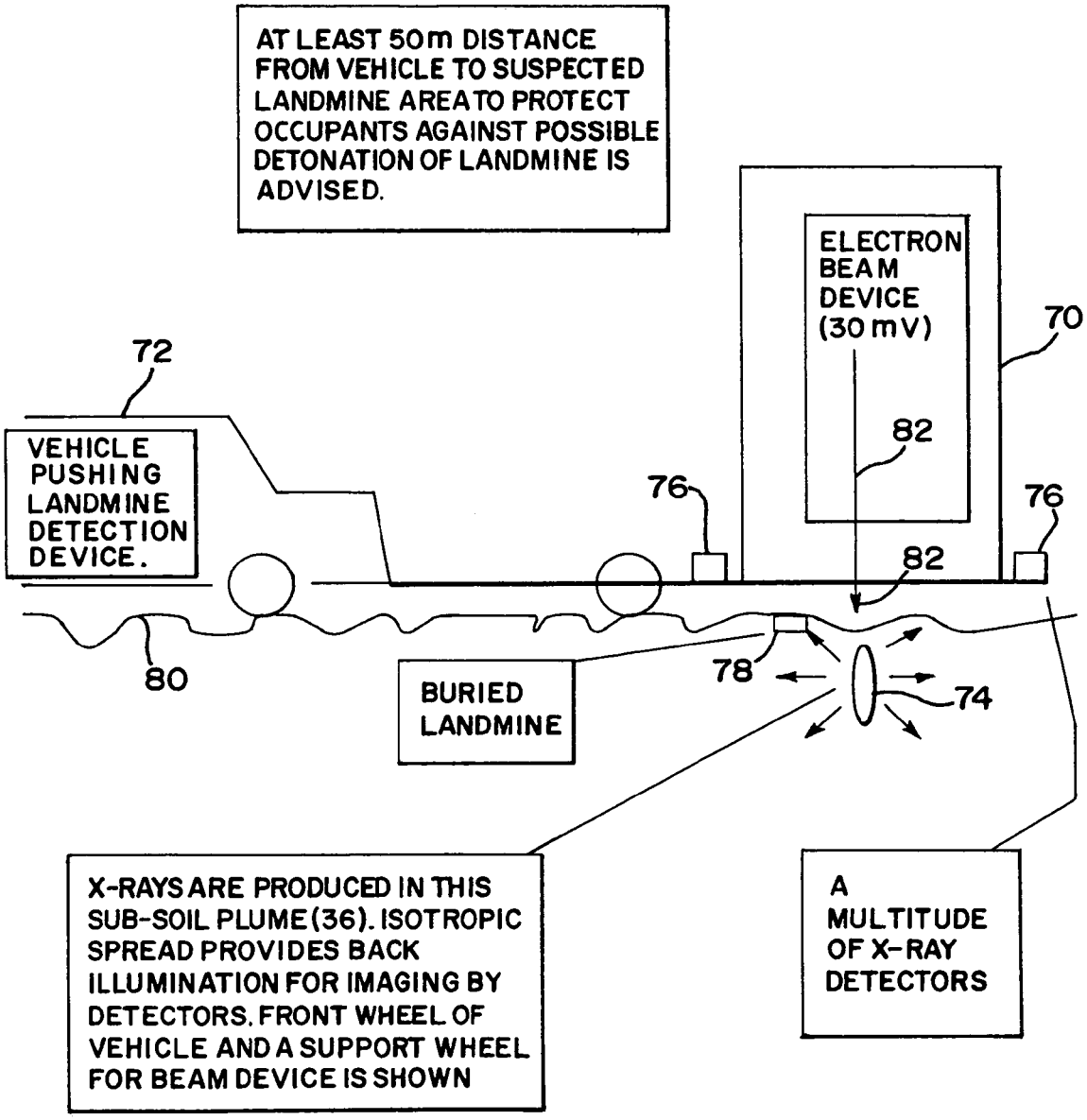
FIG. 7 shows the use of an electron beam landmine detection device.

Turning now to FIG. 7, one preferred embodiment of the directed energy device is shown as a modification with much lower voltage and perhaps current as well to use electron beams to locate landmines and concealed explosives. In this presently preferred embodiment, the directed energy device 70 is propelled by a wheeled vehicle 72. Also indicated in FIG. 7 are a subsoil plume 74 marking the volume where x-rays are produced resulting from the electron beam impacting the soil 80, and separate detectors 76 of x-radiation used to form an image. A concealed landmine 78 is also shown.

Landmines 78 do not usually contain significant metallic content so that they are not detectable by simple eddy current or any other conductivity-sensitive metal detectors. This also means that x-ray contrast will likely be low. Analogously, mammography imaging is done at a relatively low x-ray energy of 17.5 kV. This value is chosen to maximize the ability to visualize sub-centimeter tumors as well as normal tissue. Other medical x-rays are done at 50 to 100 kV for skeletal, lung and gastrointestinal studies. The higher voltage has more penetrating power but, with the resulting transparency, most tissue details vanish.

When using x-rays to image tissue in medical applications, the photons can undergo three possible events. They can pass through the tissue (and add to the background), they could be attenuated (and reduce the intensity at the detector providing attenuation contrast), or they could be scattered (and blur adjacent areas, reducing contrast). The scattered photons are usually considered undesirable. Therefore in many medical x-ray devices, scatter-absorbing grids are used to suppress those photons. However, there is valuable information lost in this process. To a microscopist, this lost information is called dark field contrast or dark field imaging, and can be a valuable imaging mode. There are two ways of dealing with scattered photons: they might be used to generate dark field images since the signal may be large in magnitude, or they can be ignored (but then probably should be blocked—otherwise there is detrimental blurring of adjacent areas in a bright field image).

Radiologists commonly use visual clues such as distortions or variations in the tissue architecture in the neighborhood of the disease rather than see the disease itself. There are clear and obvious contrast variations and distortions in local tissue environment that are easy for the semi-trained observer to find. A well-trained mammographer will be far better at distinguishing normal (benign) features from malignant features. There is no one single indicator that is always there as a positive reliable marker although certain patterns of specks of calcification can sometimes serve as indicators.

The above effects can be applied to generate similar techniques to find landmines 78 among buried rocks, roots and other items that could cause a false positive signal. Since there are only a limited number of commercially available landmines 78, the various known silhouettes could be stored in a memory device (not shown) and later retrieved to be compared as key markers of a landmine 78 for example. Another approach would rely on the spatial orientation relative to the soil surface and depth of burial. Since metal or other crystalline structures are not usually used in significant quantity in landmines 78, there is probably little chance that at certain momentum transfers there will be sharp scattering of x-rays that could be used to identify mines 78.

According to one presently preferred landmine detector 70, an intense and energetic electron beam 82 is injected into the soil in order to produce x-rays. The range of high energy x-rays in soil is at least several meters so we can consider ideas involving detectors 76 at least 1 or 2 meters distant (see below). Key to this concept would be a method of producing x-rays below the soil surface with detectors at or very near the surface a few meters distant. As described below, it is possible to generate sufficient x-rays subsurface without mechanically digging holes and having to place an x-ray tube down below the surface.

The electron beam energy becomes dissipated as heat and x-rays (and of course light in some cases). X-rays are produced when energetic (in comparison to rest-mass energy) electrons are slowed, change direction, or stopped suddenly when they impact an atom of relatively high atomic number. This is called bremsstrahlung or breaking radiation. Electrons can travel in atmosphere and to a lesser extent in soil. To maximize injury, antipersonnel landmines 78 are usually buried to a short depth of 0-5 cm. A useful rule of thumb is that the maximum range of electrons expressed in $gm/cm^2$ is half the energy in MeV. That means the device 70 needs to operate at approximately 30 MV. The range in atmosphere ($1.2\ mg/cm^3$) of a 30 MV electron beam is 120 m and the range in soil ($1.2\ gm/cm^3$) is thus 12 cm. As the beam electrons interact with atoms in the soil, they undergo directional changes before they stop. The resulting x-radiation is emitted in all directions from a plume 74 beneath the soil 80. X-rays are also emitted when impacted atoms undergo induced orbital transitions from k and l shells if energetically possible. These x-rays are also emitted in all directions. (Accordingly, shielding might be needed in a commercially sold device in order to protect the user.)

Efficiency of x-ray production via a bremsstrahlung mechanism strongly depends on electron energy. According to one empirical formula, the efficiency is electron energy (MeV) times atomic number of the substrate divided by 750. The conversion of electron beam energy to x-ray energy for a medical application is 0.1 to 0.2% since tungsten (Z=74) and molybdenum (Z=42) are typical anode materials. Using silicon (Z=14) and an electron energy at 20 Mv, 24% of electron beam energy is transformed into x-ray energy in the subsoil 80 beneath the beam landing area. As the electrons gradually slow due to successive interactions with the substrate, the efficiency also gradually drops, but overall, the efficiency is still 50 fold higher than medical imaging efficiency. This estimate is based on the lower atomic number of soil compared to tungsten or molybdenum. The x-ray intensity produced in medical imaging is typically a watt or so. This is limited by thermal damage to the metallic anode—which is not a problem in this case of landmine 78 detection.

The common constituent elements of soil (Si, O, N, Al, Ca, C, Na, Mg, P, K), all have exponential x-ray mass attenuation coefficients between 0.01 and 0.02 $cm^{-1}$ at 20 MV. Using an average mass attenuation of 0.015 $cm^{-1}$, 1 meter of soil would attenuate 22% of 20 MeV x-rays. Considering the Megawatts of x-rays expected (see below), there would be ample x-ray intensity at 1 or 2 meters beneath the soil surface 80, or even more, for the beam to illuminate and image any objects in the volume of interest. This means that an intense electron beam directed into the ground could be used to generate a bright source of isotropic x-rays in a plume 74 relatively deep inside the soil 80 and below the level of buried landmines 78. An array of detectors 76 positioned on or slightly above the soil 80 could then be placed in a position to detect a shadow of a landmine 78.

A smaller and lower voltage version of the orbiting electron beam directed energy weapon described above can be readily adapted for use as the landmine detection device 70. For example, during the short time of operation, the device's beam has high energy. One thousand amps at 30 MV is 30 Gwatts. Considering the 24% conversion efficiency for the landmine detector FIG. 7, there would be peak x-ray intensity of 7.2 Gwatts or 9-10 orders of magnitude larger than the typical x-ray medical application. (The energy in the beam is the power times duration of the pulse. For 0.1 msec pulses, this amounts to 1 Mjoule per pulse of x-ray output.) The comparison to medical output is not exactly appropriate, however, since in medical applications the beam-landing diameter on the anode is a fraction of a millimeter while it could be as large as 1 cm in the case of landmine detection while also operating with shorter pulses. However, by reducing the beam current considerably (perhaps by a thousand-fold or more), it greatly simplifies the electron gun and electronics for this aspect of the invention.

One presently preferred landmine detector includes a series of slightly curved conductive plates (not shown) ranging in size from a few centimeters to about a meter in diameter with an aperture for each of the individual approximately 100,000 or even far fewer beams. Optics is designed so that the individual beams clear the apertures. The space charge for each individual beam is ignorable in this case. The beams 82 are aimed to converge a meter or so outside the gun 70 (FIG. 7) at a point 10-15 cm below the soil surface 80. Assuming that there is one plate supporting the electron sources and 10-100 more equally spaced 5 to 100 cm apart, each plate is 0.3 to 3 MV less negative and might have its own rotational energy storage setup (as described above). This would address how to power the plates while each is at a different high voltage. The rotational energy could be built up during times when the beam is idle and will be readily available for times of need. A reasonable rotational energy storage unit includes 1 to 10 kg rings, each having a 10 cm diameter and rotating at 100 to 1000 revolutions per second. Chemical energy (pinwheel rockets or small motors), electrical energy, or gas jets could alternatively be used to get the storage wheels up to rotational speed (as described above). The electron beam exits a vacuum chamber (not shown) as explained previously through a thin conductive membrane or preferably a plasma valve (not shown).

The 30 MV device also preferably includes an insulation layer at least 30 inches in radius, which is added to the gun 70 column dimension. This applies to the device at the top where the voltage is largest and the requirement decreases linearly down the column. It is possible that the high voltage breakdown limitation will be far less than as described since the device is not to be used in a focusing mode. That is, high voltage stability is not needed and the voltage does not need to stabilize for long periods of time to reduce aberration. Pulsing the power on for only short times considerably lessens the breakdown problem. It is, therefore, possible that the device will need less insulation spacing than is considered above.

The electron gun is preferably enclosed in a high vacuum environment—so the device would need to be housed in a sealed container and pumped to needed vacuum levels. The beam exits through a thin vacuum barrier/window, which might need cooling in the preferred embodiment. Another alternative embodiment uses a plasma to form the window.

Since landmines 78 are a relatively small (2-12 cm) in size, the incident electron beam cannot be too large in landing diameter since it will limit resolution. A beam diameter of a centimeter or less is therefore preferred. The plume 74 will be larger and that needs to be considered. High current beam pulses would provide high detector signal-to-noise ratio. A reasonable mode of operation is thus to use a 30 MV beam of electrons with 1 pulse per second of 1 to 1000 amps and 0.1 msec duration into a 1 cm diameter spot on the soil surface 80. Another mode would be to use less current per pulse such as milli-amps or even less and more pulses per second such as 10-1000. With such small currents, it is possible to use small radio-frequency driven accelerators such as cyclotrons to produce the current pulse. An array of 100 or more x-ray detectors 76 arranged in a circle 2-4 meters in diameter from the electron beam 82 would collect image information. An algorithm can select areas as suspicious for landmines if image silhouettes were similar to that from known manufactured landmines or even mechanical actuators that connect to deeper buried landmines. That is, landmines might be buried deeper than can be detected by techniques such as ground penetrating radar. A mechanical connection to these deeper landmines could be a wooden dowel that is not detectable with ground penetrating radar, but might well be seen with back illuminated x-radiation.

The above-described landmine detection device operates in either a dark field contrast mode or a bright field contrast mode. The landmine detector also may operate in a scanned mode much like a scanning electron microprobe or microscope. It also functions similar to a computed tomography imaging device as used in medical imaging. The device thus takes many x-ray views of a subject from different angles and combines the images using known algorithms to produce cross-section images.

FIG. 8 shows an alternative embodiment of an electron beam directed energy device to locate landmines and concealed explosives. This version is air-based and is preferably carried by a helicopter 90. A 30 MV electron gun 92 is slung beneath a helicopter in this embodiment with the electron beam exit pointing down. A grid array of x-ray detectors 94 is supported by a mechanical framework similar to when the detectors are resting on the soil surface 80 when the electron gun 92 is a meter or so off the surface 80. Readings are taken of the area under the grid and then the helicopter 90 moves to another area for another scan procedure. It is possible that the detectors are separate from the electron beam device and stay fixed on the ground for certain applications.

The electron landmine detector is thus preferably located close to or on the ground and carried by a ground vehicle (as shown in FIG. 7) or by a helicopter (FIG. 8), but may also be carried by a balloon or fixed-wing aircraft. If a ground-based vehicle carries the device, an electrical ground connection (not shown) could provide the means to prevent excessive charging of the electron beam device as electrons are emitted. Otherwise, means for expelling positive charges in conjunction with electron emission is needed to prevent excessive charging (as described above).

Scattered or reflected or re-emitted radiation up from the ground could also be used to detect the presence of nitrogen or any other specific material that is an indicator of explosives. The nitrogen component in landmines is 18-38% by weight while in soil it is less than 0.1% by weight. It may even be possible to detonate explosives with an energetic electron beam. It is also contemplated that this device could produce intense x-ray energy that could be used to search for precious minerals and objects such as gold, silver, diamonds or the like.

It is to be appreciated that a wide range of changes and modifications to the above examples of the best modes for carrying out the invention are contemplated without departing from the essential spirit and scope of the invention. It is therefore intended that the foregoing detailed description be regarded as illustrative rather than limiting, and that it be understood that it is the following claims, including all equivalents, that are intended to define the spirit and scope of this invention.

I claim:

1. A directed energy device comprising:

an electron gun generating a plurality of electron beams, said plurality of electron beams disposed such that their beam axes are oriented in a pre-configured direction and separation to substantially overcome Coulomb repulsion at a point greater than 100 kilometers distant;

an electron accelerator positioned after the electron gun consisting of a plurality of sequential conductive shaped plates, each plate having at least one aperture per electron beam where the apertures are positioned at the respective beam's axis, and the shape of the plates is essentially normal to the electron beams, the approximate spacing of the plates from adjacent plates is larger than the electrical breakdown limit; and means for applying voltages to each conductive plate relative to other conductive plates.

2. The directed energy device of claim 1 having a beam envelope that exceeds 1 m in any diameter.

3. The directed energy device of claim 1 wherein the device is used to direct energy to a target.

4. The directed energy device of claim 1 wherein the device is used as a weapon.

5. The directed energy device of claim 1 wherein the device is directed to targets above the atmosphere.

6. The directed energy device of claim 1 wherein the device is directed to targets within the atmosphere.

7. The directed energy device of claim 1 in which the pre-configured direction and separation of the beams is designed by considering the other charged particles to be a continuum of charges.

8. The directed energy device of claim 1 in which the pre-configured direction and separation of the beams is designed by considering the other charged particles to be discrete charges.

9. The directed energy device of claim 1 wherein the means for applying the separate plate voltages comprises an energy storage device.

10. The directed energy device of claim 9 wherein the energy storage device comprises at least one flywheel.

11. The directed energy device of claim 1 disposed in an environment defining a pressure of less than $10^{-5}$ torr.

12. The directed energy device of claim 1 wherein the plurality of particle beams are disposed such that the beams are convergent to a point at a specified distance greater than 100 km from the exit of the device.

13. The directed energy device of claim 1 wherein the electron gun produces an energy of over 0.1 GV beam voltage and over 100 amps total beam current with a beam landing of less than 50 cm diameter at a distance greater than 100 km.

14. The directed energy device of claim 1 wherein the placement of the apertures in the conductive plates corresponds to trajectories that will mostly direct the electrons to land at a target within a landing diameter.

15. The directed energy device of claim 1 having at least one high voltage capacitor between at least one pair of conductive plates.

16. The directed energy device of claim 1 having voltage provided by at least one high voltage power supply between at least two conductive plates.

17. The directed energy device of claim 1 wherein some electron beams originate at different voltages to provide different electron energies.

18. The directed energy device of claim 1 wherein at least one charged plate has a conductive surface on a nonconductive substrate.

19. The directed energy device of claim 1 wherein at least one conductive plate is foldable for transportation into space.

20. The directed energy device of claim 1 wherein at least one conductive plate can be rolled up for transportation into space.

21. The directed energy device of claim 1 wherein power provided for at least one conductive plate by using stored rotational energy in at least one flywheel.

22. The directed energy device of claim 1 further comprising means for jettisoning an approximately equal positive charge as the electron beam carries away.

23. The directed energy device of claim 1 having at least two conductive plates mechanically aligned and attached one to another using at least one high voltage insulator.

24. The directed energy device of claim 1 wherein at least one conductive plate is free to move.

25. The directed energy device of claim 24 wherein at least one conductive plate is free to move with motion provided by gas jets.

26. The directed energy device of claim 24 wherein the at least one conductive plate alignment is measured by at least one laser beam directed down alignment apertures in at least one conductive plate.

27. The directed energy device of claim 24 wherein the at least one conductive plate alignment is measured by at least two laser beams directed down different size apertures for separate coarse and fine alignment.

28. The directed energy device of claim 1 wherein conductive plate-to-plate spacing is approximately equal between all plates.

29. The directed energy device of claim 1 wherein conductive plate-to-plate spacing is larger than the minimum spacing limited by breakdown electric field strength.

30. The directed energy device of claim 1 wherein steering of the beam after it exits from the last conductive plate uses magnetic fields.

31. The directed energy device of claim 1 wherein steering of the beam after it exits from the last conductive plate uses electric fields.

32. The directed energy device of claim 1 wherein the plurality of electron beams comprises at least 10 charged particle beams and at least 100 sequential conductive shaped plates, each plate being at least 1 meter in a diameter.

33. The directed energy device of claim 1 wherein positive charges are removed from the device by charging capacitors and jettisoning the positive plates in conjunction with electron beam operation.

34. The directed energy device of claim 1 further comprising an array of test targets appropriately positioned in space and periodically hit with a lower than 100 amp current but full-voltage beam for calibration of aiming.

35. The directed energy device of claim 1 further comprising an array of test targets appropriately positioned in space and periodically hit with a duration less than 0.1 msec but full-voltage beam for calibration of aiming.

36. The directed energy device of claim 1 wherein an array of magnetic field measuring devices are appropriately positioned to provide information on the local magnetic field for determining beam aiming to hit a target.

37. The directed energy device of claim 1 enclosed within a container that is evacuated by at least one vacuum pump.

38. The directed energy device of claim 1 wherein steering of the beam after it exits from the last conductive plate uses electric fields and magnetic fields.

39. The directed energy device of claim 1 wherein the device is used as an electron beam directed energy weapon.

40. The directed energy device of claim 1 wherein the device is used to destroy targets.

41. The directed energy device of claim 1 supported by a balloon within the earth's atmosphere.

42. The directed energy device of claim 1 disposed in orbit above the earth's atmosphere.

43. The directed energy device of claim 1 disposed in geosynchronous orbit above the earth's atmosphere.

44. The directed energy device of claim 1 carried on an airplane within the earth's atmosphere.

45. A directed energy device comprising:

an electron gun having at least one beam of electrons, said at least one beam of electrons disposed such that at least one beam axis is oriented towards the surface of the earth and is located at a position of up to 200 meters above the surface of the earth;

an electron accelerator, the electron accelerator operable to energize the electrons to between 10 MeV and 100 MeV; and wherein the directed energy device is operable to deposit energy subsurface.

46. The directed energy device of claim 45 used to generate x-rays directed from beneath the surface of the earth.

47. The directed energy device of claim 45 used to provide back-illumination for detecting concealed explosives.

48. The directed energy device of claim 45 wherein the beam is scanned to provide multiple images for detecting concealed explosives.

49. The directed energy device of claim 45 wherein image shapes that do not correspond to known landmine shapes are rejected.

50. The directed energy device of claim 45 further comprising x-ray absorbing grids to attenuate scattered radiation.

51. The directed energy device of claim 45 further comprising x-ray absorbing grids to attenuate unscattered radiation.

52. The directed energy device of claim 45 used to locate valuable buried items.

53. The directed energy device of claim 45 further comprising a plasma valve to allow beam exit from vacuum to atmosphere.

54. The directed energy device of claim 45 wherein the device is used to destroy landmines.

55. The directed energy device of claim 45 wherein excess charge is jettisoned as the device operates.

56. The directed energy device of claim 45 further comprising a membrane window to allow beam exit from vacuum to atmosphere.

57. The directed energy device of claim 45 wherein the at least one beam of electrons are aimed toward a point 10-15 cm below the surface.

58. A method for impacting ballistic missiles using a directed energy device, comprising the steps of:

generating a plurality of electron beams, said plurality of electron beams disposed such that their beam axes are oriented in a pre-configured direction and separation to substantially overcome Coulomb repulsion at a point greater than 100 km distant;

positioning an electron accelerator consisting of a plurality of sequential conductive shaped plates, each conductive shaped plate containing at least one aperture per electron beam, wherein the apertures are positioned at the respective beam's axis, and the shape of the conductive shaped plates being essentially normal to the electron beams, the approximate spacing of the plates from adjacent plates is larger than the electrical breakdown limit; and applying voltages to each of the plurality of conductive shaped plates relative to the other of the plurality of conductive shaped plates.

59. A method for detecting landmines using a directed energy device, comprising the steps of:

providing an electron gun having at least one beam of electrons, said at least one beam of electrons disposed such that at least one beam axis is oriented towards the surface of the earth, the position of the electron gun being located at a position of up to 200 meters above the surface of the earth;

providing an electron accelerator operable to energize the electrons to between 10 MeV and 100 MeV; and depositing the energy from the electrons at or below the surface of the earth.

* * * * *